United States Patent [19]

Kircher

[11] 4,340,460

[45] Jul. 20, 1982

[54] INTERNAL DOWNCOMER FOR ELECTROLYTIC RECIRCULATION

[75] Inventor: Morton S. Kircher, Clearwater, Fla.

[73] Assignee: Olin Corporation, New Haven, Conn.

[21] Appl. No.: 209,634

[22] Filed: Nov. 24, 1980

[51] Int. Cl.[3] ..... C25B 9/00; C25B 11/03; C25B 15/08

[52] U.S. Cl. ..... 204/258; 204/266; 204/284; 204/288

[58] Field of Search ..... 204/252–258, 204/263–266, 288, 289, 284, 237

[56] References Cited

U.S. PATENT DOCUMENTS

| | | | |
|---|---|---|---|
| 3,855,091 | 12/1974 | Piester | 204/128 |
| 3,898,149 | 8/1975 | Kircher et al. | 204/252 |
| 3,928,150 | 12/1975 | Rahn et al. | 204/98 |
| 3,928,165 | 12/1975 | Piester | 204/278 |
| 4,076,603 | 2/1978 | Andersen | 204/98 |
| 4,138,295 | 2/1979 | DeNora et al. | 204/98 |
| 4,174,266 | 11/1979 | Jeffery | 204/98 |
| 4,210,516 | 7/1980 | Mose et al. | 204/289 X |
| 4,212,714 | 7/1980 | Coker et al. | 204/98 |
| 4,217,199 | 8/1980 | Cunningham | 204/256 |
| 4,279,731 | 7/1981 | Pellegri | 204/289 X |
| 4,295,953 | 10/1981 | Fuseya et al. | 204/263 X |
| 4,315,810 | 2/1982 | Kircher | 204/263 X |

*Primary Examiner*—Donald R. Valentine

*Attorney, Agent, or Firm*—Ralph D'Alessandro; Donald F. Clements; Thomas P. O'Day

[57] ABSTRACT

In a filter press membrane electrolytic cell having a plurality of electrodes, each electrode being of predetermined thickness and separated from the adjacent electrode by an ion-selective permeable membrane all supported by a frame and in fluid flow communication with a gas-liquid disengager there is provided an improved electrolyte return line having a first portion external to each electrode and a second portion internal to each electrode, wherein the second portion fits within the predetermined thickness in a structurally reinforcing manner so that the structural rigidity of the electrode is increased while the electrode surface area available for fluid contact is maximized.

28 Claims, 6 Drawing Figures

INTERNAL DOWNCOMER FOR ELECTROLYTIC RECIRCULATION

BACKGROUND OF THE INVENTION

The present invention relates generally to the system utilized to recirculate electrolyte from a gas-liquid disengager to the electrochemical cell. More specifically, the present invention relates to an improved downcomer for an anolyte or catholyte return line that connects the appropriate gas-liquid disengager and each electrode within the chloralkali electrochemical cell in a manner which improves the efficiency of gas separation in the disengager and strengthens the cell structurally. The improved downcomer could be used equally well to return catholyte from the catholyte gas-liquid disengager to each cathode frame or to return anolyte from the anolyte gas-liquid disengager to each anode frame with the same advantages.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type electrolytic cell or the flowing mercury cathode-type. Comparatively recent technological advances, such as the development of the dimensionally stable anode and various coating compositions, have permitted the gap between electrodes to be substantially decreased. This has dramatically increased the current efficiency in the operation of these energy-intensive units.

The development of a hydraulically impermeable membrane has promoted the advent of filter press membrane chloralkali cells which produce a relatively uncontaminated caustic product. This higher purity product obviates the need for caustic purification and concentration processing. The use of a hydraulically impermeable planar membrane has been most common in bipolar filter press membrane electrolytic cells. However, advances continue to be made in the development of monopolar filter press membrane cells.

Replenishing the depleted electrolyte, typically a salt brine, has been accomplished in diaphragm cells by having feed lines carry a portion of the fresh electrolyte via external feed lines through external gas-liquid disengagers into a tank holding a plurality of electrodes. Those prior art structures which replenished the electrolyte internally either utilized the existing electrode frame side channels to carry the fresh electrolyte towards the bottom of the electrode or fed the electrolyte into the electrode from the top through short feed lines. The former method potentially weakened the frame structure or restricted the flow rate capacity to that achievable within the existing electrode frame design dimensions. The latter method failed to mix the fresh electrolyte thoroughly with the existing electrolyte in the electrode. Neither method optimized cell efficiency by ensuring maximum separation of the gases from the electrolyte prior to recycling and replenishing the electrolyte.

Monopolar filter press membrane cells are characterized by the utilization of hollow electrode leaves bordered by gasketed frames in which anode and cathode leaves alternate. Each anode and cathode is separated by an ion-selective permeable membrane, which is held between each pair of electrode frames. Because of the high cost of the materials required, it is desirable to have a maximum of electrode surface area per unit of cross-sectional area and per unit of volume for each electrode. However, this optimum in economy must be balanced by the practicality of design where it is necessary to make the electrode leaves thick enough to contain conductor bars, to permit the internal flow of gases and liquids, and to provide sufficient area for the attachment of inlet and outlet conduits. Compounding design problems is the proven fact that chlorine gas contact with the membranes utilized in the monopolar filter press membrane electrolytic cells tends to accelerate deterioration of the membrane structure, thereby negatively affecting the performance and life of the membrane. External anolyte and catholyte gas-liquid disengagers have been employed recently in an attempt to maximize the available electrode surface area per unit volume for each electrode. Thus, it is advantageous to separate as much as possible of the chlorine gas from the anolyte outside of the anode; in other words, in the anolyte gas-liquid disengager so that there is minimal exposure of the membrane to the chlorine gas.

Similarly, since hydrogen gas is produced in the cathode during electrolysis, it is desirable to have as much of the hydrogen gas as possible removed from the catholyte in the catholyte gas-liquid disengager to improve the efficiency of the cathode while structurally strengthening the cathode.

The foregoing problems are solved in the design of the apparatus comprising the present invention by providing in a filter press membrane electrolytic cell external gas-liquid disengagers to maximize the ratio of the electrode surface per unit of cross-sectional area and per unit of volume so as to separate out entrained chlorine gas from the anolyte fluid and hydrogen gas from the catholyte fluid at desired rates by providing a downcomer or anolyte return line for each anode and a downcomer or catholyte return line for each cathode that have a first portion external to each electrode and a second portion internal to each electrode, the first portion being at least partially generally circular in cross-section and the second portion having in cross-section a generally arcuate periphery with a predetermined cross-sectional dimension such that the downcomer is contiguous to the opposing sides of the electrode in a structurally reinforcing manner so that the structural rigidity of the electrode is increased while the electrode surface area available for fluid contact is maximized per unit of electrode cross-sectional area and per unit of volume while permitting electrolyte to be circulated from the disengager into the electrode during the electrolytic process.

SUMMARY OF THE INVENTION

It is a principal object of the present invention to provide in an electrolytic filter press membrane cell an improved design for the return line in an electrode to supply fresh electrolyte and to return electrolyte from which gas has been separated in an external gas-liquid disengager to the bottom of each electrolyte compartment within the electrode.

It is another object of the present invention to provide a return line which structurally reinforces the electrode frame.

It is a feature of the present invention that the return line or downcomer pipe is appropriately flattened in the portion inside the electrode so it will fit within the limits imposed by the thickness of the frame while maintaining the optimum ratio of maximum electrode surface per unit of cross-sectional area and per unit of volume.

It is another feature of the present invention that the downcomer or return line can be welded to the electric current conductor rods providing further structural rigidity to the entire electrode.

It is yet another feature of the present invention that the return line can be extended to within a desired predetermined distance of the bottom of the electrode frame to promote more complete recirculation of the electrolyte fluid.

It is an advantage of the present invention that improved internal circulation within the compartment of the electrode is achieved by its design.

It is another advantage of the present invention that the cross-sectional area available for transporting and recirculation of the electrolyte fluid is maximized.

These and other objects, features and advantages are obtained in an electrolytic filter press membrane cell having a plurality of electrodes, each electrode being of predetermined thickness separated by an ion-selective permeable membrane, the electrodes being of generally the same predetermined thickness, each supported by a frame, an electrolyte gas-liquid disengager connected to each electrode having an improved electrolyte return line with a first portion external to each electrode and a second portion internal to each electrode, the first portion being at least partially of generally circular cross-section and the second portion having in cross-section a generally arcuate periphery with a predetermined cross-sectional dimension that corresponds to the predetermined thickness such that the periphery is contiguous to the opposing sides of the electrode in a structurally reinforcing manner so that the structural rigidity of the electrode is increased while the electrode surface area available for fluid contact is maximized per unit of electrode cross-sectional area and per unit of volume so that the return lines permit a flow of electrolyte such that the gas fraction in the electrolyte within the electrodes does not exceed a predetermined percentage by volume of flow of the electrolyte from the respective electrolyte gas-liquid disengagers back into each electrode and the flow varies between a predetermined gallon per minute flow range per kiloampere of current.

BRIEF DESCRIPTION OF THE DRAWINGS

The advantages of this invention will become apparent upon consideration of the following detailed diclosure of the invention, especially when it is taken in conjunction with the accompanying drawings wherein.

DETAILED DESCRIPTION OF THE PREFERRED EMBODIMENT

Figure 1:
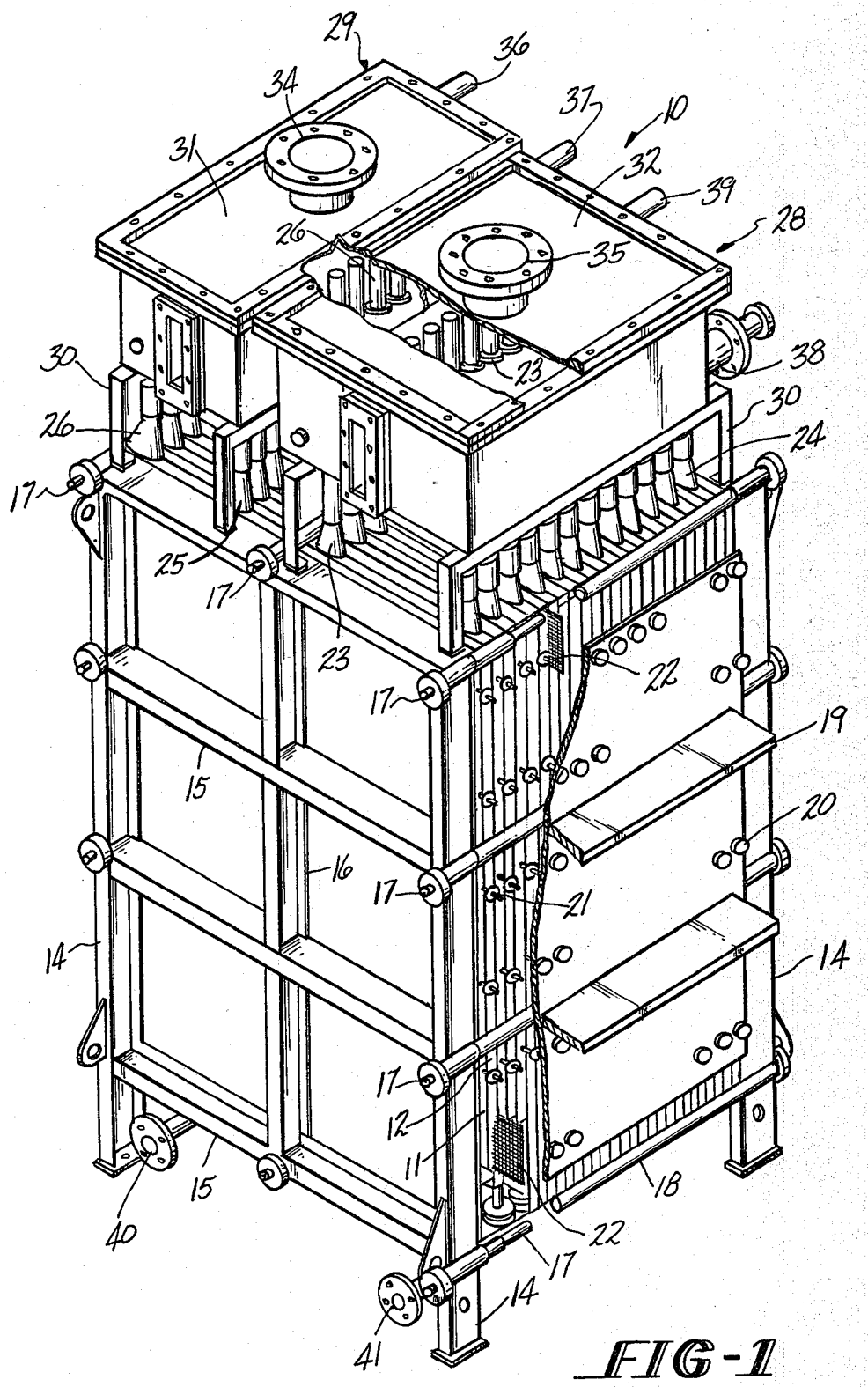
FIG. 1 is a side perspective view of a monopolar filter press membrane electrolytic cell with appropriate portions broken away to illustrate the anodes and cathodes and the anolyte and catholyte gas-liquid disengagers.

Referring to FIG. 1 a filter press membrane cell, indicated generally by the numeral 10, is shown in a side perspective view. It can be seen that cathodes 11 and anodes 12 alternate and are oriented generally vertically. The cathodes 11 and anodes 12 are supported by vertical side frame members 14, horizontal side frame members 15, and intermediate vertical side frame members 16 (only one of which is shown). The cathodes and anodes are pressed together and secured by a series of tie bolts 17 which are inserted through appropriate mounting means affixed to the vertical side frame members 14. To prevent short circuiting between the electrodes during the electrolytic process, the tie bolts 17 have tie bolt insulators 18 through which the tie bolts 17 are passed in the area of the cathodes 11 and anodes 12.

This electrical current is passed from an external power source through the cathode bus 19 and then via cathode bus nuts 20 into the cathode conductor rods 21. From that point, the conductor rods 21 carry the current into the cathodes 11. Although not shown, a similar arrangement of anode bus, anode bus nuts and anode conductor rods conduct current into each of the anodes. The anodic conducting means are present on the opposing side of the filter press membrane cell 10 from the cathodic conducting means just described. Ion-selective permeable membranes 22 are diagramatically shown in FIG. 1 to illustrate how each anode and cathode are separated by the membrane.

Projecting from the top of the anode and cathode are a series of fluid flow conduits. FIG. 1 shows anode risers 23 and anode downcomers or anolyte return lines 24 projecting from the top of each anode 12. Similarly, cathode riser 25 and cathode downcomer or catholyte return line 26 is shown projecting from the top of each cathode 11. The risers are generally utilized to carry the entrained gas, either chlorine gas in the anolyte or hydrogen gas in the catholyte, and the appropriate electrolyte fluid to the appropriate disengager mounted atop of the filter press membrane cell 10.

The anolyte disengager is indicated generally by the numeral 28, while the catholyte disengager is indicated generally by the numeral 29. Each disengager is supported atop of the cell 10 by disengager supports 30. It is in each of these disengagers that the entrained gas is enabled to separate out from the liquid of the anolyte or catholyte fluid, as appropriate, and is released from the appropriate disengager via either a catholyte gas release pipe 34 or an anolyte gas release pipe 35 affixed to the appropriate catholyte disengager cover 31 or anolyte disengager cover 32.

Also partially illustrated in FIG. 1 is the catholyte replenisher conduit 36 which carries deionized water into the catholyte disengager 29. The deionized water is appropriately recycled through each cathode 11 in cell 10. A catholyte outlet pipe 37 carries caustic from the disengager 29 to the appropriate processing apparatus and helps maintain the liquid at the appropriate level in the catholyte disengager with the aid of an appropriate trap (not shown). An anolyte replenisher conduit 38 carries fresh brine into the anolyte disengager 28. The fresh brine is then appropriately circulated into each anode 12 with the existing anolyte fluid which is recirculated. An anolyte outlet pipe 39 is partially shown and serves to maintain the electrolyte fluid in the anolyte disengager at the appropriate level with the aid of an appropriate trap (not shown) within the pipe. Also shown in FIG. 1 is a cathodic bottom manifold 40 and an anodic bottom manifold 41 which are utilized to drain the appropriate electrodes and, if desired, to facilitate recirculation of electrolyte.

The filter press membrane cell 10 has been described only generally since its structure and the function of its central components are well known to one skilled in the art. A more detailed and thorough description of the filter press membrane cell 10 is found in U.S. Patent Application Ser. No. 128,684, filed Mar. 10, 1980, now abandoned and assigned to the assignee of the present invention, hereinafter specifically incorporated by reference in pertinent part insofar as it is consistent with the instant disclosure.

Figure 2:
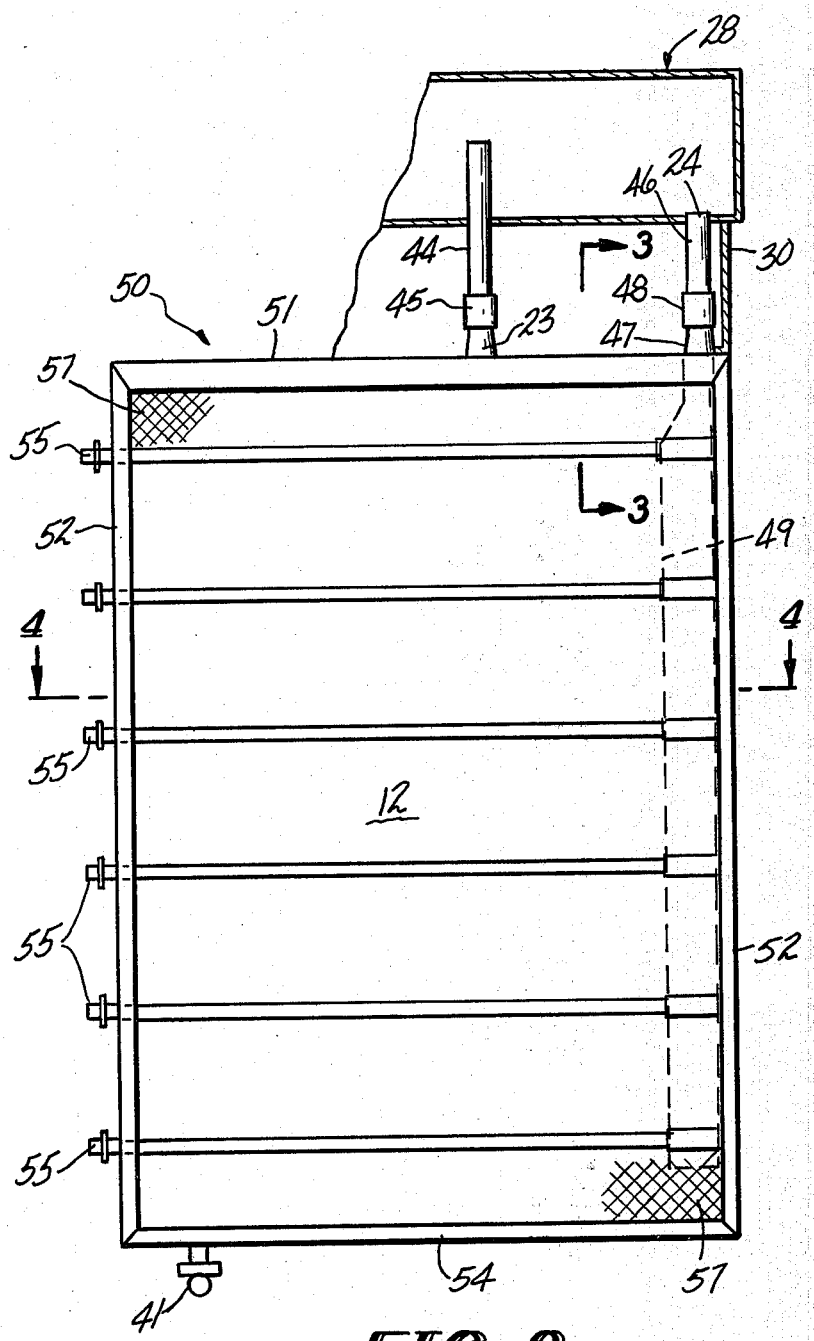
FIG. 2 is a side elevational view of an anode showing the improved anolyte return line and the fluid flow conduits connecting the anode to the anolyte disengager.

Referring now to FIG. 2, the fluid flow conduits from the anode 12 are shown in side elevational detail, along with a single anode 12. The anode riser 23 is seen extending upwardly into the anolyte disengager 28, as is the anolyte downcomer or return line 24. The anode riser 23 is seen comprising a circular cross-section portion 44 which is connected to the riser portion 23 that extends from the top of the anode 12. A hose 45 or other suitable gasketing material connects the two conduits and can be appropriately fastened thereto by a clamp or other suitable means. The anolyte downcomer 24 is shown comprising a circular cross-section portion 46, a tapered portion 47 and a flattened portion 49 which is contained entirely within the anode. A hose or other suitable material 48 connects the circular cross-section portion 46 and the tapered portion 47. Hose 48 is appropriately clamped to the conduits.

Still referring to FIG. 2, the anode 12 is seen comprising an individual anode frame indicated generally by the numeral 50. Anode frame 50 further comprises an anode top channel 51, also seen in FIG. 3. The top channel 51 is appropriately fastened to anode side frame members 52, which are in turn appropriately fastened to an anode bottom frame member 54. Conductor rods 55 extend through one of the side frame members 52 and extend generally horizontally into the anode 12. An annular ring 56 is fastened appropriately about each rod 55. The opposing electrode surfaces 57 of the anode 12 are covered by an appropriate surfacing material, such as a metal mesh, (see also FIGS. 3 and 4). The mesh is appropriately fastened to the opposing edges of the anode side frame members 52, such as by welding, as best seen in FIG. 4. This mesh or other suitable material, which comprises the opposing electrode surfaces 57, is similarly fastened to the anode top channel 51 and the anode bottom frame member 54. The opposing electrode surfaces 57 and each anode frame 50 combine to define a fluid permeable area or compartment within which anolyte fluid is retained.

Figure 3:
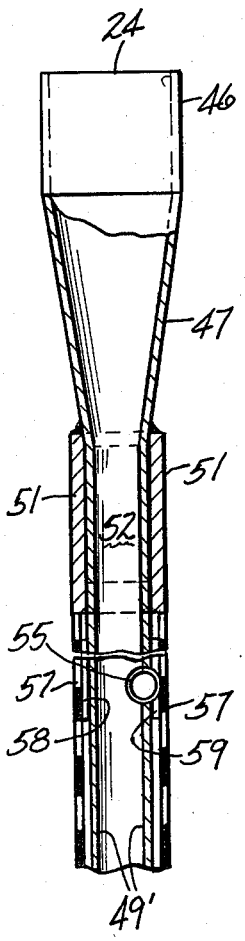
FIG. 3 is a sectional view taken along the line 3—3 of FIG. 2 showing a portion of an anode and the anolyte return line as the line passes through the top channel of the frame and enters the anode.
Figure 4:
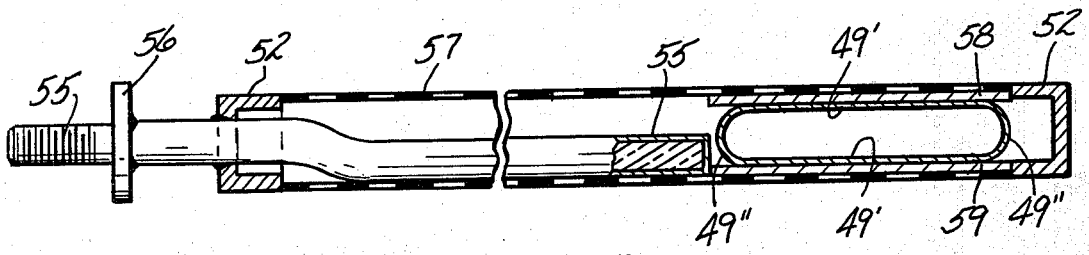
FIG. 4 is a sectional view taken along the line 4—4 of FIG. 2 showing in top plan view a portion of the anode with the positioning of the conductor rods and the improved internal anolyte return line.

The anolyte return line or downcomer 24 with its flattened side portion 49 placed within the anode frame 50 is best shown in FIGS. 3 and 4. As can be seen most clearly from FIG. 4, the flattened section 49 comprises a pair of opposing and generally parallel sides 49′ connected on opposing ends by arcuate end sections 49″. At least one of the sides 49′ is welded to a weld bar 59 which reinforces the anode frame 50. A spacer bar 58 is also shown in FIG. 4. Spacer bar 58 provides a firm fitting for the internal portion of the downcomer 24 within the anode frame 50. Alternately, the flattened section 49 of the donwcomer 24 could also be welded to the spacer 58, thereby providing further structural rigidity to the anode.

It also should be recognized that the electrode compartments formed by the electrode frames and the electrode surfaces are not impermeable to the flow of electrolyte therethrough. It is the inclusion of the hydraulically impermeable membranes 22 between each cathode 11 and anode 12 which preserves the liquid integrity between electrodes and the separate electrolytic chambers defined by the membranes 22 and each electrode.

ALTERNATE EMBODIMENT

Figure 5:
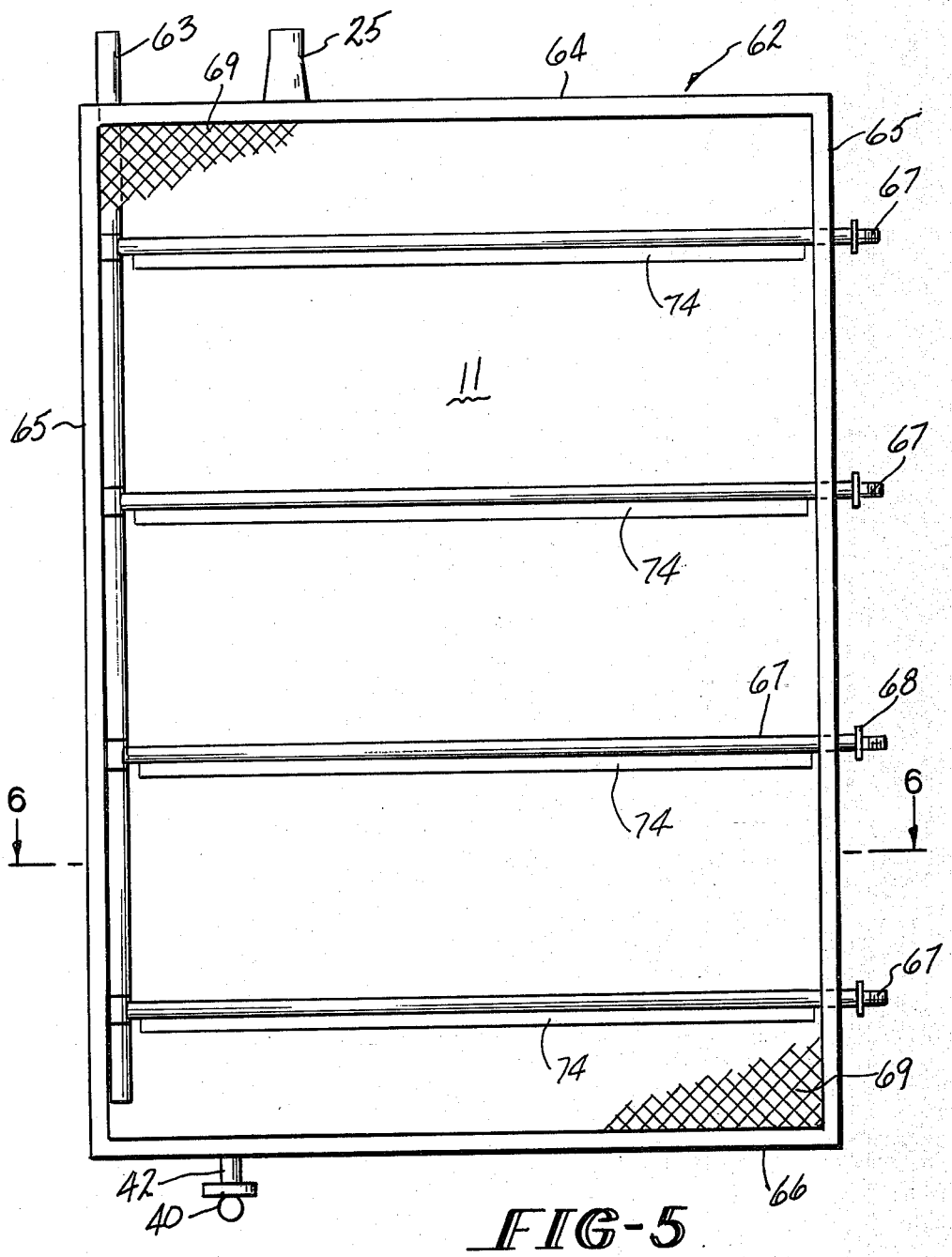
FIG. 5 is a side elevational view of a cathode showing an alternative embodiment of the improved electrolyte return line with the covering mesh of the anode surface partly broken away.
Figure 6:
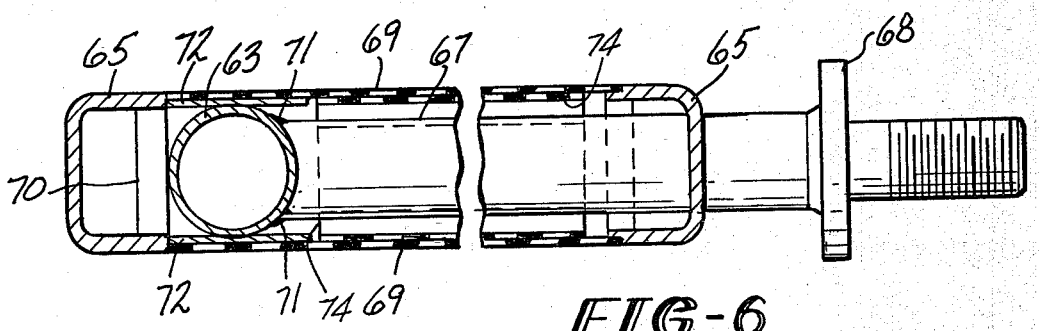
FIG. 6 is a sectional view taken along the line 6—6 of FIG. 5 showing in top plan view the positioning of the conductor rods and the internal electrolyte return line within the cathode.

FIGS. 5 and 6 show an alternative embodiment of the improved internal downcomer electrolyte return line utilized in an intermediate cathode of a cell 10. The improved internal downcomer in its alternate embodiment could equally well be utilized in the two end cathodes of a filter press membrane cell. As seen in FIG. 5 the individual cathode frame is indicated generally by the numeral 62 and the internal downcomer or catholyte return line is indicated as 63. The cathode riser 25 extends a predetermined distance from the top of the cathode top channel 64 to connect with catholyte disengager 29 (not shown). Channel 64 is appropriately fastened to opposing cathode side frame members 65 which are in turn appropriately fastened to the cathode bottom frame member 66. The cathodic bottom manifold 40 (not shown) is connected to the cathode compartment by pipe 42. Extending through one of the cathode side frame members 65 are a plurality of cathode conductor rods 67. Each rod on its external portion has an annular ring 68 appropriately fastened thereto. It should be noted that when assembled the filter press membrane cell 10 has alternating cathodes and anodes with the conductor rods extending from alternating opposing sides. A cathode surface 69 of nickel mesh is appropriately fastened, such as by welding, to the opposing surfaces of the frame.

As best seen in FIG. 6, the internal catholyte downcomer or return line 63 is inserted within the cathode frame 62 such that it reinforces the frame's structure. A cross bar 70 connects the opposing sides of the channel of the side frame member 65, adjacent the circular downcomer 63. Downcomer 63 on the opposing side from cross bar 70 is welded at weldments 71 to the cathode conductor rods 67 (only one of which is shown). Weld plates 72 are at opposing sides of the cathode frame and are welded to the side frame members 65. Plates 72 are positioned such that they are contiguous with downcomer 63 to thereby add further structural rigidity to the frame. Electric current is passed from conductor rods 67 via inverted U-like shaped members 74 to the opposing cathode surfaces 69. Members 74 are porous, having a grid-like surface to permit electrolyte fluid to pass therethrough.

It should also be noted that the improved downcomer can be utilized in a cathode, as well as an anode frame, with the same attendant and previously enumerated advantages. Regardless of whether the improved downcomer is used in an anode or a cathode, it has been found beneficial to utilize a Schedule 10 pipe that may be flattened to the appropriate thickness to permit the pipe to fit within the dimensions of the appropriate electrode.

In order to exemplify the results achieved, the following Example is provided without any intent to limit the scope of the instant invention to the discussion therein.

EXAMPLE

A monopolar filter press cell was fabricated having an anode sandwiched between two end cathodes, the anode and each cathode being separated by an ion-selective permeable membrane. The anode was 84 inches high, 60 inches wide, and $1\frac{1}{2}$ inches thick. The individual anode frame was constructed of $\frac{1}{4}$ inch thick titanium in the side frame members with channels having $1\frac{1}{2}$ inch webs and 1 inch opposing sides. Both sides of the anode were faced with activated titanium mesh. The top of the anode frame comprised a top channel constructed of $\frac{1}{8}$ inch thick titanium with a $1\frac{1}{2}$ inch by 3 inch deep channel. The cathodes were of the same dimensions and were clamped on opposing sides of each anode frame. The individual cathode frames were constructed from nickel.

Six $\frac{3}{4}$ inch diameter titanium clad copper conductor rods were welded to the anode mesh, internally extending through one of the anode side frame member channels toward the exterior on the opposing side. A 2 inch Schedule 10 pipe was flattened to 1 inch, except for approximately 6 inches which was intended to extend above the top channels of all of the electrode frames. The flattened portion was then inserted vertically through the top channel of each electrode frame, adjacent to the channel frame on the opposing side from which the six titanium clad copper rods were inserted into the electrode. This Schedule 10 pipe, the improved downcomer, was seal welded at the top and extended to within approximately 6 inches of the bottom of the electrode. This length of the downcomer was approximately 90 to 95% of the height of each electrode. The cathode frames were generally constructed similarly to the anode frames except that the titanium mesh was replaced by nickel and was placed on only one surface. Additionally, the conductor rods extended into the electrode compartment from the opposite side to that from which the anode conductor rods entered the electrode.

The gas-liquid disengagers were generally rectangular in size, each being 15 inches high and 4 inches wide. The anolyte disengager for the chlorine was 32 inches long and the catholyte disengager for the hydrogen was approximately 20 inches long. The bottom of the anolyte disengager was 28.75 inches above the top of the cell and the catholyte disengager was positioned 15 inches above the top of the cell. Both the riser pipes and the downcomer pipes were 2 inch Schedule 10 pipes with hose couplings. The riser pipe generally extended about 6 inches above the bottom of the disengager.

At a current of 12.0 KA (2 KA/M$^2$), with an anolyte fluid of 20% NaCl at 90° C. and a catholyte fluid of 40% NaOH at 92° C., a return flow of 47 gallons per minute was developed. The foam depth in the anolyte disengagers varied from approximately 7 inches during the first month of operation to approximately 2.5 inches after several months of operation. The anolyte fluid was measured to have an estimated gas fraction of 16%. At a flow rate of 8 gallons per minute, the gas fraction in the anolyte fluid was calculated to be 38%. The cell voltage corresponding to the high and low flow rates was 3.85 and 3.90, respectively.

In operation a filter press membrane cell 10 has an electric current from an external source conducted via an anode bus bar, anode bus bolts and anode conductive rods into each anode frame. Similarly, electrical current is conducted via the cathode bus 19, the cathode bus nuts 20, and the cathode conductor rods 21 into each cathode 11. Electrolyte fluid, principally a salt brine from the anolyte feed pipe 38, is fed via the anolyte disengager 28 down through the anolyte donwcomer 24 into each anode. The catholyte fluid, utilizing deionized water fed through the catholyte feed pipe 36, circulates fluid through the catholyte disengager 29 and then downwardly through each catholyte downcomer 26 into each cathode 11. The electrolytic process causes the freeing of chlorine from the salt brine and hydrogen from the deionized water.

The chlorine rises as a gas entrained in the anolyte fluid through anolyte riser 23 into the anolyte disengager 28. Within the disengager 28 the chlorine gas is permitted to separate from the anolyte fluid and leaves the disengager via anolyte gas relief pipe 35 to the appropriate gas processing apparatus. In the cathode, the hydrogen is entrained with the catholyte fluid and rises with the catholyte fluid, including the appropriate caustic, through the cathode riser 25 into the catholyte disengager 29. The hydrogen gas is separated from the catholyte fluid and leaves the disengager via the catholyte gas release pipe 34 which is connected to appropriate processing apparatus.

The brine and the deionized water are replenished in each electrode frame via suitable conduit means. The improved downcomers in both the anodes and the cathodes are designed to fit within the frame of each anode and cathode in a manner that maximizes the electrode surface area available per unit of cross-sectional area and per unit of volume. These return lines further permit the internal flow of electrolyte fluid at a rate which sustains the pressure within each electrode compartment at a level sufficient to maintain a gas fraction of not greater than about 20% by volume. The return flow of anolyte fluid is such that the gas fraction in the anolyte fluid within the anode compartment in contact with the membrane does not exceed about 20% by volume while the flow of anolyte from the anolyte gas-liquid disengager back into each anode ranges from between 2 to 4 gallons per minute per kiloampere of current.

While the preferred structure in which the principles of the present invention have been incorporated is shown and described above, it is to be understood that the invention is not to be limited to the particular details thus presented, but in fact, widely different means may be employed in the practice of the broader aspects of this invention. The scope of the appended claims is intended to encompass all obvious changes in the details, materials and arrangement of parts which will occur to one of skill in the art upon a reading of the disclosure.

Having thus described the invention, what is claimed is:

1. In a monopolar filter press membrane electrolytic cell for the production of halogen gas having:

(a) elongate frame means supporting the cell;

(b) a plurality of elongate planar cathodes of predetermined height and length supported by the frame means;

(c) a plurality of elongate planar anodes of predetermined height and length generally parallel to the cathodes, each anode being sandwiched between a pair of cathodes;

(d) electrolyte circulatable through the cell at a predetermined rate;

(e) a catholyte gas-liquid disengager supported by the frame and connected to each cathode to permit gas to separate from the electrolyte in the cathodes;

(f) an anolyte gas-liquid disengager supported by the frame and connected to each anode to permit gas to separate from the electrolyte in the anodes;

(g) fluid flow conduit means interconnecting the cathodes and the catholyte gas-liquid disengager;

(h) a plurality of fluid flow conduit means interconnecting the anolyte gas-liquid disengager and each anode wherein at least one of the conduit means has a first portion outside of each anode extending into the anolyte disengager and a second portion within each anode, the first portion at least partially of generally circular cross-section and the second portion having in cross-section generally elongate parallel opposing first and second sides interconnected on opposing ends by arcuate members and extending down into each anode a predetermined distance less than the predetermined height of the anode;

(i) conducting means connecting to the anodes and the cathodes for conducting electrical current thereto, the conducting means further comprising a plurality of conductor rods extending into at least each anode and having welded thereto said at least one of the conduit means to provide structural stiffness to the cell; and (j) electric power means connected to the cell to drive the electrolytic reactions therein.

2. The apparatus according to claim 1 wherein each of the anodes further comprises a frame of predetermined thickness within which said at least one of the conduit means is inserted and is contiguous with at least the first opposing side so that the frame is reinforced thereby.

3. The apparatus according to claim 2 wherein said at least one of the conduit means extends into each anode approximately six inches less than the predetermined height of the anode therein.

4. The apparatus according to claim 2 wherein said at least one of the conduit means extends into each anode for a distance that is approximately 90 to 95% of the predetermined height of the anode.

5. The apparatus according to claim 1 wherein the cross-section of said at least one of the conduit means comprises an area sufficient to permit the gas fraction in the anolyte gas-liquid disengager to be maintained below about 20% by volume while permitting a flow of electrolyte from the anolyte gas-liquid disengager back into each of the anodes between 2 to 4 gallons per minute per kiloampere of current.

6. The apparatus according to claim 5 wherein the predetermined thickness of each of the anode frames is approximately $1\frac{1}{2}$ inches.

7. In a filter press membrane electrolytic cell having a plurality of anodes, each anode being of predetermined thickness and sandwiched between a pair of cathodes all supported by a frame, an anolyte gas-liquid disengager connected to each anode, the improvement comprising:

an improved anolyte return line having a first portion external to each anode and a second portion internal to each anode, the first portion being at least partially of generally circular cross-section and the second portion having in cross-section generally elongate parallel opposing first and second sides interconnected by opposing arcuate ends fitting within the predetermined thickness, at least the first side reinforcing the anode so that the return line permits a flow of anolyte such that the gas fraction of the electrolyte within the anode does not exceed about 20% by volume while the flow of the anolyte from the anolyte gas-liquid disengager back into each anode is between 2 to 4 gallons per minute per kiloampere of current.

8. The apparatus according to claim 7 wherein the filter press membrane electrolytic cell further comprises a plurality of conductor rods extending into each anode and to which are welded the anolyte return line to provide structural stiffness to the cell.

9. The apparatus according to claim 8 wherein each anode has a predetermined height.

10. The apparatus according to claim 9 wherein the anolyte return line extends down into each anode approximately 6 inches less than the predetermined height of the anode.

11. The apparatus according to claim 9 wherein the anolyte return line extends down into each anode a distance that is approximately 90 to 95% of the predetermined height of the anode.

12. The apparatus according to claims 10 or 11 wherein the predetermined thickness of each of the anode frames is approximately $1\frac{1}{2}$ inches.

13. An electrode for a filter press membrane electrolytic cell adapted to be utilized in a cell pack with an ion-selective permeable membrane between each electrode, the electrode further being in fluid flow communication with a gas-liquid disengager and comprising:

(a) a generally planar frame having two opposing surfaces with a top portion, a bottom portion and two opposing sides describing the perimeter of the electrode, the top portion and bottom portion further having a predetermined length, the two opposing sides having a predetermined height and the entire frame having a generally uniform predetermined thickness;

(b) a plurality of conductor means extending through one of the opposing sides;

(c) covering means affixed to the two opposing sides thereby defining two opposing electrolytic surfaces and forming an electrode compartment therebetween within which the conductor means extend;

(d) a first fluid flow conduit connected to the top portion and the disengager to permit fluid to pass from the electrode compartment to the disengager for gas separation; and (e) a second fluid flow conduit connecting the disengager and the electrode comprising at least a first portion and an elongate second portion, the first portion being at least partially of generally circular cross-section extending from the top portion into the disengager, the second portion extending from within the top portion to some distance less than the predetermined height towards the bottom portion, the second portion further having an arcuate periphery with a predetermined cross-sectional dimension corresponding to the predetermined thickness such that the second fluid flow conduit is connected to the top portion and the two opposing surfaces in a structurally reinforcing manner so that the structural rigidity of the electrode is increased while the electrode surface area available for fluid contact is maximized per unit of electrode cross-sectional area and per unit of volume while permitting electrolyte to be circulated from the disengager into the electrode during the electrolytic process.

14. The apparatus according to claim 13 wherein the electrode further comprises an anode.

15. The apparatus according to claim 14 wherein the second fluid flow conduit has a cross-sectional area sufficient to permit the gas fraction in the anode to be maintained below about 20% by volume while permitting a flow of fluid from the disengager back into the anode of between 2 to 4 gallons per minute per kiloampere of current.

16. The apparatus according to claim 13 wherein the electrode further comprises a cathode.

17. The apparatus according to claims 14 or 16 wherein the conductor means further comprises a plurality of conductor rods extending into the electrode compartment and to which is welded the second fluid flow conduit to provide stiffness to the electrode.

18. The apparatus according to claim 17 wherein the second portion of the second fluid flow conduit extends from within the top portion towards the bottom portion approximately 6 inches less than the predetermined height.

19. The apparatus according to claim 17 wherein the second portion of the second fluid flow conduit extends from within the top portion towards the bottom portion a distance that is approximately 90 to 95% of the predetermined height.

20. The apparatus according to claim 18 wherein the predetermined thickness of the frame is approximately $1\frac{1}{2}$ inches.

21. The apparatus according to claim 19 wherein the predetermined thickness of the frame is approximately $1\frac{1}{2}$ inches.

22. In a filter press membrane electrolytic cell having a plurality of electrodes, each electrode being of a generally uniform predetermined height and a generally uniform predetermined thickness bounded by opposing surfaces and supported by a frame defining a predetermined surface area, cross-sectional area and electrolyte fluid volume capacity, each electrode further being connected to an external gas-liquid disengager, the improvement comprising in combination:

(a) an improved electrolyte return line having a first portion external to each electrode and a second portion internal to each electrode, the first portion connecting the electrode to the disengager and extending above the predetermined height of the electrode, the second portion being generally elongate with a periphery that fits within the predetermined thickness and extends into the electrode some distance less than the predetermined height such that the periphery is connected with the opposing surfaces in a structurally reinforcing manner so that the structural rigidity of the electrode is increased while the electrode surface area is maximized per unit of electrode cross-sectional area and per unit of volume while permitting electrolyte to be circulated from the disengager into the electrode during electrolytic process; and (b) a plurality of conductor rods extending through the electrode frame between the opposing surfaces for conducting an electrical current through the electrode during the electrolytic process, the conductor rods being welded to the improved electrolyte return line to provide structural rigidity to the electrode.

23. The apparatus according to claim 22 wherein the electrode further comprises an anode.

24. The apparatus according to claim 23 wherein the electrode further comprises a cathode.

25. The apparatus according to claim 22 wherein the second portion has an arcuate elongate periphery and extends approximately 6 inches less than the predetermined height.

26. The apparatus according to claim 22 wherein the second portion has an arcuate elongate periphery and extends a distance that is approximately 90 to 95% of the predetermined height.

27. The apparatus according to claims 25 or 26 wherein the predetermined thickness of the electrode is approximately $1\frac{1}{2}$ inches.

28. The apparatus according to claim 27 wherein the improved electrolyte return line has a cross-sectional area sufficient to permit the gas fraction in the anode to be maintained below about 20% by volume while permitting a flow of fluid from the disengager back into the anode of between 2 to 4 gallons per minute per kiloampere of current.

* * * * *